US010899491B2

(12) United States Patent
Riva

(10) Patent No.: US 10,899,491 B2
(45) Date of Patent: Jan. 26, 2021

(54) EQUIPMENT AND CORRESPONDING METHOD FOR MANAGING COMMERCIAL ITEMS

(71) Applicant: ORS GROUP GMBH, Munich (DE)

(72) Inventor: Pierluigi Riva, Alba (IT)

(73) Assignee: ORS GROUP GMBH, Munich (DE)

( * ) Notice: Subject to any disclaimer, the term of this patent is extended or adjusted under 35 U.S.C. 154(b) by 0 days.

(21) Appl. No.: 15/534,703

(22) PCT Filed: Dec. 9, 2015

(86) PCT No.: PCT/EP2015/079057
§ 371 (c)(1),
(2) Date: Jun. 9, 2017

(87) PCT Pub. No.: WO2016/091921
PCT Pub. Date: Jun. 16, 2016

(65) Prior Publication Data

US 2018/0265239 A1 Sep. 20, 2018

(30) Foreign Application Priority Data

Dec. 9, 2014 (EP) ..... 14196884

(51) Int. Cl.
*B65C 9/46* (2006.01)
*B65C 1/02* (2006.01)
(Continued)

(52) U.S. Cl.
CPC ..... *B65C 9/46* (2013.01); *B65C 1/021* (2013.01); *B65C 9/02* (2013.01); *B65C 9/44* (2013.01);
(Continued)

(58) Field of Classification Search
CPC .. B65C 9/46; B65C 1/021; B65C 9/02; B65C 9/44; B65C 2009/401; B65C 2009/405; B41J 3/4075
See application file for complete search history.

(56) References Cited

U.S. PATENT DOCUMENTS 5,401,353 A * 3/1995 Westbury ..... B65C 3/12 156/156
5,427,029 A * 6/1995 Dumke ..... B65C 1/00 101/484
(Continued)

FOREIGN PATENT DOCUMENTS

| | | |
|---|---|---|
| EP | 2 716 560 A1 | 4/2014 |
| JP | 2004-026313 A | 1/2004 |
| JP | 2009 -083908 A | 4/2009 |

OTHER PUBLICATIONS

International Search Report issued in connection with PCT/EP2015/079057.

*Primary Examiner* — Sonya M Sengupta
(74) *Attorney, Agent, or Firm* — Akerman LLP

(57) ABSTRACT

Equipment (100) for processing items intended for commercial and non-commercial distribution, said equipment comprising a conveyor belt (1) for transporting and/or moving said items, means (30) for applying individually a label onto each of said items, said equipment (100) being configured so that each label is generated by means (34) for generating individual labels based on the identification data of the associated or corresponding item.

22 Claims, 1 Drawing Sheet

(51) Int. Cl.

| | |
|---|---|
| ***B65C 9/44*** | (2006.01) |
| ***B65C 9/02*** | (2006.01) |
| ***B65C 9/40*** | (2006.01) |
| ***B41J 3/407*** | (2006.01) |
| ***B41J 3/28*** | (2006.01) |

(52) U.S. Cl.
CPC ..... *B41J 3/286* (2013.01); *B41J 3/4075* (2013.01); *B65C 2009/401* (2013.01); *B65C 2009/405* (2013.01)

(56) References Cited

U.S. PATENT DOCUMENTS

| | | | | |
|---|---|---|---|---|
| 6,080,250 | A * | 6/2000 | Urban | B65C 9/1884 156/64 |
| 7,632,367 | B2 * | 12/2009 | Smith | B65C 9/02 156/64 |
| 9,352,872 | B2 * | 5/2016 | Wojdyla | B65C 9/1803 |
| 9,926,096 | B2 * | 3/2018 | Wojdyla | B65C 9/02 |
| 2006/0231209 | A1 | 10/2006 | Smith | |
| 2014/0096900 | A1 * | 4/2014 | Wojdyla | B65C 9/02 156/247 |

* cited by examiner

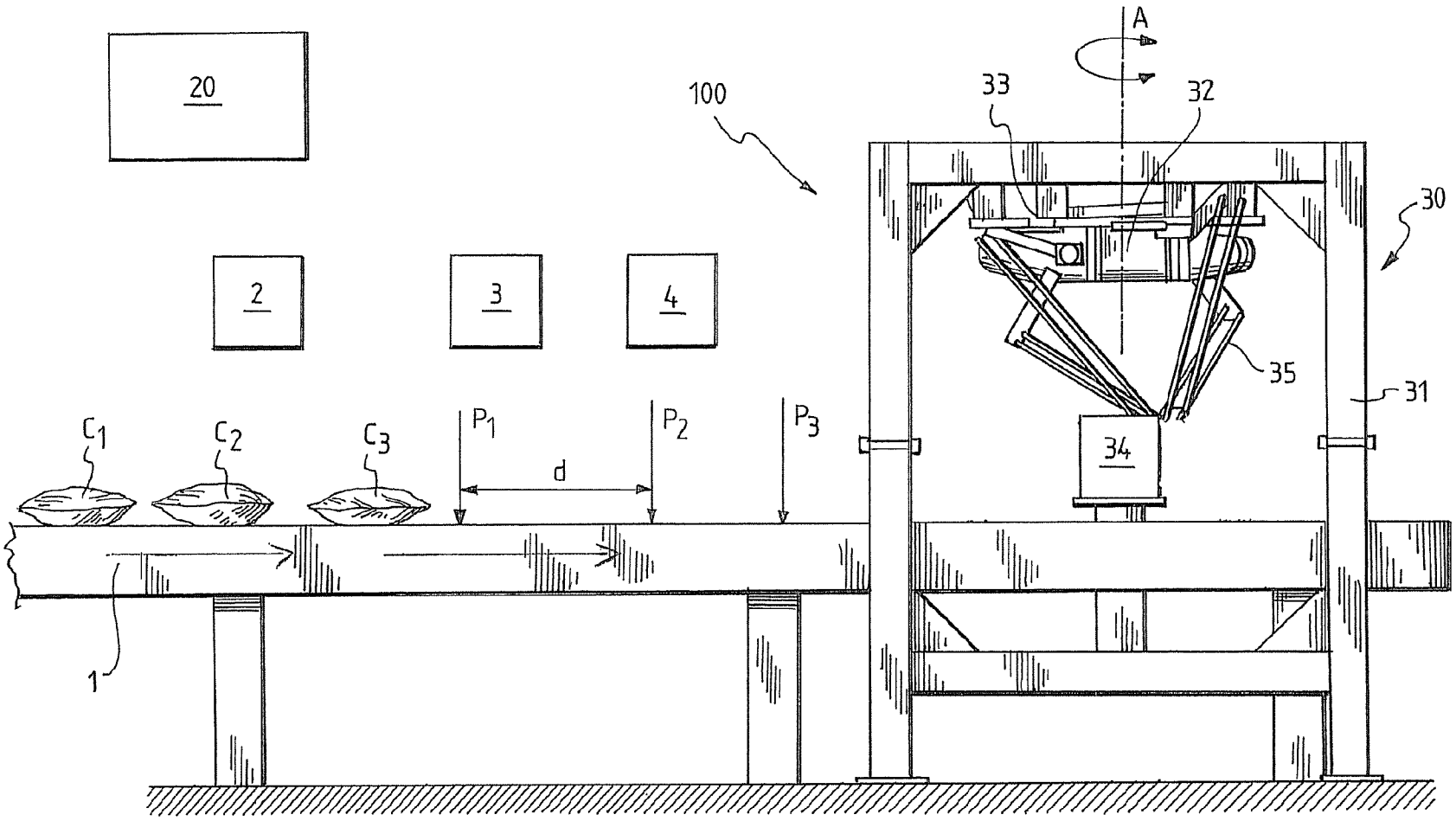
30
31
35
32
A
34
33
100
4
3
2
20
P3
P2
P1
d
C3
C2
C1
1

EQUIPMENT AND CORRESPONDING METHOD FOR MANAGING COMMERCIAL ITEMS

This application is a national phase of PCT/EP2015/079057, filed Dec. 9, 2015, and claims priority to EP 14196884.2, filed Dec. 9, 2014, the entire contents of both of which are hereby incorporated by reference.

FIELD OF THE PRESENT INVENTION

The present invention relates to the large-scale management of items intended for sale or for distribution in general. In particular, the present invention relates to the management of articles of clothing intended for distribution. In detail, the present invention relates to the labelling, in particular the pricing, of articles of clothing and/or items in general intended for sale or distribution. Even more particularly, the present invention relates to an equipment and a method for the automated large-scale pricing of articles of clothing and/or items in general which are intended for distribution or sale.

PRIOR ART

It is known that in the distribution sector, in particular for articles of clothing, there exists a need to attach onto each article, in particular on a tag applied to each article, a label with an indication of the selling price for the public and other information. In particular, it is known that there exists a need to attach onto each article a label with an indication of the selling price already at the end of the production phase of said article and at the latest immediately before packaging the article. This need arises not only from the fact that the price at which the article will be sold or offered to the public is in any case decided and/or established by the manufacturer or the main distributor (based on long-term marketing policies), but also from the objective difficulties associated with the pricing of articles at public sales outlets such as shops, boutiques and/or shopping centres, these latter difficulties being due to the time needed for manual pricing of the articles and therefore the related costs, which are nearly always unsustainable or in any case too high for the sales outlets.

The solutions adopted in the past envisage therefore generally pricing the articles immediately after production of said articles or at the latest during or at the end of packaging of the articles, but in any case before the articles reach the intended sales outlets, wherein packaging comprises applying to each article an identification label showing, in addition to the identification data of the article, such as the model, size, etc, also an indication of the selling price.

However, the solutions summarised hitherto often conflict with the market policies and are often unflexible, in particular when these policies have to be readapted to the conditions which may arise, in particular to the real demand of consumers and the varying reaction of the consumers to the price.

For instance, a known apparatus for labelling items intended for commercial or non commercial distribution is disclosed in the European patent application No. EP 2 716 560 A1. This solution, however, is not very flexible since the items are aligned along a conveyor and the time arrival of a given item is computed to activate a couple of label printer applicators located at one side of the conveyor. This solution is applied for a first labelling of regularly positioned items.

In fact, in the case where the selling price indicated initially must or may be adjusted—for example downwards in the case of a limited demand on the part of consumers and upwards in the case of particularly popular and/or appreciated products—new pricing of all the articles which have already left the production and/or packaging premises is necessary.

Furthermore modern manufacturing policies are such that the production is allocated to third parties who are often commissioned to carry out production on behalf of different designer brands or logos or client companies. Obviously, the production centres are often visited and inspected by the different clients, so that the fact that the prices are affixed on the articles by the manufacturers means that the prices may be seen by various clients with the considerable risk of compromising or in any case complicating the marketing policies of each client.

Finally, the same article of clothing must often be assigned different selling prices depending on its final destination, in particular depending on the country or region in which the article will be offered to the public; for example, an article intended to be sold in the USA may be assigned a selling price different from the selling price assigned to the same article intended to be sold in Europe or Asia. The aforementioned problem of diversification of the price depending on the final destination is partially solved by indicating for each article different prices, each relating to the country or the region where the article will be offered to the public; in fact labels with prices in dollars, Euros, etc., are common, although the difference in price, if due not only to the exchange rate, but also to the different marketing policies, may create discontent among the consumers in an area where a price is applied (net of the exchange rate), which is higher than that applied to the same article sold in another country or region.

It must also be considered that the production and delivery of the articles to the different intermediate and/or final distributors are carried out on the basis of delivery orders emitted by the same intermediate and/or final distributors, where a single order almost always relates to different products or articles with different selling prices for the public and where the same article, if included in a delivery intended for a predefined geographic and/or commercial area, must often have a price different from that applied to the same product, but included in a delivery intended for a different geographic or commercial area. At the end of the production or packaging stage, an identification tag indicating in particular the final destination is therefore applied to each article. However, in this case also, pricing during the post-production or packaging stage complicates the execution of the various orders and therefore the preparation of the corresponding deliveries.

The main object of the present invention is therefore that of overcoming or at least minimizing the problems summarized above and affecting the solutions known in the prior art.

In particular, the object of the present invention is that of proposing an innovative solution allowing the automated pricing of the articles on a large scale, but in any case individually, depending on the identification data of said article, in particular on its final destination as shown on the identification tag.

A further object of the present invention is that of proposing an innovative solution allowing different articles, eventually coming from different production centres, to be brought and/or put together in a single delivery preparation location where each article may be priced depending on the delivery for which the article is intended.

A further object of the present invention is therefore that of providing an equipment allowing the functions summarized above to be carried out. In particular, in view of further objects to be achieved, the equipment according to the present invention shall allow an increase in the margin conditions (profit margins) of each article owing to the flexibility in the application of the selling price, shall allow a significant reduction in the obsolescence cost (of the unsold article), including the financial costs, along with an improvement in the level of service offered to the clients ("right price at the right time"), shall allow reallocation of the merchandise (articles) which remain immobilized for various reasons, shall offer the possibility of reorganizing the product marketing policy, with the introduction of base orders and reorders, and finally shall prevent competitors from knowing the price policies associated with each product.

Another object of the invention is that of allowing the re-labelling of already priced articles.

DESCRIPTION OF THE PRESENT INVENTION

The present invention is therefore based on the general consideration according to which, by applying to each article, at the production or packaging platform (or in any case ahead of preparation of the deliveries), an identification tag which shows in particular also the data relating to the final destination of the said article, and by establishing a connection and/or relationship between the final destination (geographic or commercial area or also single distribution or sales outlet) and the corresponding particular selling price, it will be possible to delay the pricing operations until they coincide with the delivery and/or delivery order preparation operations. In fact, the pricing platform must simply read off the final destination of each article from the associated tag and generate the corresponding associated price, accordingly.

The present invention is also based on the further consideration that, by providing the delivery preparation and/or pricing platform with article movement means (for example a conveyor belt on which the articles coming from the production and/or packaging platforms will be brought together) and furthermore providing the delivery preparation platform with means able to track the path of each article along the said movement means, it will be possible to apply to each moving article a label with the selling price.

A further consideration on the basis of the present invention moreover relates to the fact that, by means of the aforementioned tracking means adapted to identify the position of the article at successive time points during their travel inside the platform, it will be possible to instruct automated label application means, for example a robot, so as to obtain application of the label on the article in one of the positions occupied by the article along its travel path.

The present invention is also based on the further consideration that, by means of a centralized management of the entire platform for preparation of the deliveries, the same platform may be enabled to generate the labels (individually depending on the individual data, in particular the destination of each article), apply the associated label to each article, and earmark each article for a delivery (assign each article to a fredefined delivery). Moreover, according to a further consideration on the basis of the present invention, by means of the possibility of remotely managing the delivery preparation platform, in particular by means of the possibility of entering and/or loading in the platform the data relating to the selling price for each product, the individual pricing may be performed taking into account general marketing policies, developed depending on the market situations which might arise and which may be common to all the delivery preparation platforms or may also be different for each platform.

On the basis of the general considerations mentioned above as well as in the light of the problems or drawbacks affecting the solutions according to the prior art, the present invention relates to equipment for processing items intended for commercial distribution, said equipment comprising transportation means, for example a conveyor belt, for transporting and/or moving said items, identification means for identifying each of said items, means for generating an individual label for each of said items, as well as means for applying individually each of the said individual labels to the associated or corresponding item, said equipment being configured so that said individual labels are generated by said means for generating said individual labels, each depending on the identification data of the associated or corresponding item, as acquired by the said identification means.

According to a preferred embodiment of the equipment according to the present invention the said identification means may comprise at least one bar code reader and a tele and/or video camera.

According to an advantageous embodiment of the equipment according to the present invention the said means for generating said individual labels comprise at least one adhesive label printer.

Optionally, the equipment according to the present invention may also comprise tracking means able to track the path of at least one portion of each of said items, said equipment being further configured so that said individual labels are applied by said means for applying the individual labels each onto the said portion of the associated or corresponding item depending on (as a function of) the data of the path of the said associated or corresponding item.

According to a further alternative embodiment of the equipment according to the present invention, the said tracking means may comprise recognition means able to recognize at least one marker applied to each of said items and track the path of each of said markers.

According to an embodiment, in the equipment according to the present invention, the said tracking and/or recognition means may comprise at least one video camera.

According to a further constructional variant and/or embodiment of the equipment according to the present invention, said tracking means are able to detect the path of each of the said markers in the visual field of said at least one telecamera, said equipment further comprising means adapted to calculate or extrapolate the position of each of the said markers downstream of the visual field of said at least one video camera and within the radius or area of action of said means for applying the said individual labels.

Advantageously, the equipment according to the present invention may further comprise means for detecting the height of each of the said items at least in the radius or area of action of said means for applying said individual labels, said means for detecting the height of each of said items being optionally able to detect the height of each of said markers and comprising optionally at least one optical sensor.

According to a further embodiment, in the equipment according to the present invention said means for applying said individual labels may comprise pick-up means for picking up individually each of said labels from the said means for generating said individual labels and individually applying each of said individual labels onto the associated or corresponding item.

According to a possible embodiment, in the equipment according to the present invention the said pick-up means comprise a Venturi effect pick-up head able to detach individually each of the individual labels from a strip of adhesive labels.

Advantageously, in the equipment according to the present invention, the said application and/or pick-up means comprise a robot able to move at least individually each of the said individual labels at least between its pick-up position and its position for application to the associated or corresponding item and/or marker.

According to a further embodiment the equipment according to the present invention is managed electronically by means of at least one control unit.

Optionally, in the equipment according to the present invention, said at least one control unit may be able to receive from an external source individual data and/or instructions relating to each of the said items and compare said individual data and/or instructions received from said external source with the individual data of each of the said items detected by said identification means and manage the generation of each of said individual labels depending on the combination of said data and/or instructions as received from said external source and the data as detected by said identification means.

According to a further constructional variant or embodiment, in the equipment according to the present invention said at least one control unit is able to receive said individual data and/or instructions relating to each of the said items by cable and/or wirelessly.

Further embodiments of the present invention are defined in the claims.

The present invention also relates to a method for managing, in particular for labelling items, in particular, but not exclusively articles of clothing, intended for distribution.

DESCRIPTION OF THE DRAWINGS

In the following, the present invention will be explained in detail by means of the detailed description of its embodiments as depicted in the set of drawings in which corresponding parts and/or features of the present invention are identified by the same reference numbers. The present invention however is not limited to the embodiments described below and depicted in the set of drawings; to the contrary, the scope of the present invention is defined by the claims.

In the drawings:

FIG. 1 shows a schematic side view of the equipment according to an embodiment of the present invention.

DETAILED DESCRIPTION OF THE PRESENT INVENTION

The present invention finds convenient application in the clothing sector, in particular for applying labels to articles of clothing, even more particularly for individually pricing the articles of clothing; this is therefore the reason why, in the following, the present invention will be explained and described with particular reference to its applications in the clothing sector.

The possible applications of the present invention, however, are not limited to the clothing sector; on the contrary, the present invention may be applied in an equally convenient and advantageous manner to the management, movement and in particular labelling of items and articles of any type.

In FIG. 1, the equipment according to the embodiment depicted therein is identified by the reference numeral 100. As already mentioned, the equipment is intended for the processing, in particular the labelling, of items or articles (for example articles of clothing) to be despatched for commercial distribution. The equipment 100 comprises in particular a conveyor belt 1 for moving said items or articles, in particular for transporting the items along a predefined path (from left to right as indicated by the arrow in the example shown in FIG. 1).

The aforementioned items or articles, in particular also of a different type, as supplied by the production and/or packaging platforms (which may also be different), are loaded onto the belt 1, each of the said items being provided with a tag (for example a label) showing an identification code, for example a bar code, the tag or label being assigned (for example inserted inside the package) already during production and/or packaging of the article and in any case during a step prior to loading of the article onto the conveyor belt 1 so as to be visible (in particular legible) from outside the package. For example, the tag may be fixed externally to the package or alternatively positioned inside the package, in this case opposite a window in the package or also in any position in the case of a transparent package (for example made of cellophane).

For the sake of illustrational clarity it will be assumed in the following, in the case of the items C1, C2 and C3 loaded onto the belt 1, that same relate respectively tf a pair of jeans, a jumper and a shirt, wherein the identification code shown on each of the respective tags will allow one to determine and/or retrieve both the type of product (jeans, jumper or shirt) and optionally the location and date of manufacture, etc.

The equipment further comprises means 2 for identifying the items or articles, for example a bar code reader able to read the bar code on the tag of each article, thus recognizing and identifying each of the articles or items C1, C2 and C3, the means 2 being connected (wirelessly or by cable) to the central unit 20 and being configured so that signals may be sent to the unit 20.

The equipment 100 also comprises means 3 and 4 arranged downstream of the identification means 2 and adapted to track the path of at least one portion of each of said items as explained and described in more detail in the following. According to a non-limiting embodiment of the present invention, each of the means 3 and 4 may for example comprise a video camera, in particular adapted to capture and record at least one particular portion of each item or article, for example a marker shown on the identification tag.

For example, according to constructional variants or embodiments, each or both telecameras 3 and 4 may comprise a telecamera, model Basler Ace acA 1300-30 uc Color with Global Shutter, resolution 1296×966, 1/1.8" CMOS sensor with 5.3 μm pixel, USB3 connection and lens with 6 mm focal length, and/or a telecamera, model Point Grey FL2-08S2c-C with global shutter, resolution 1032×776, ⅓" CCD sensor with 4.65 μm pixel, firewire connection and lens with 6 mm focal length.

The two (or even three, depending on the thickness of the items) telecameras or video cameras 3 and 4, each provided in a fixed position, are in particular connected to the central unit 20 (wirelessly or by cable) so that the unit 20, on the basis of the images received from the video cameras 3 and 4 (relating to the moving items), by processing said images, identifies the spatial (or at least the planar) coordinates of the marker of each item or article with respect to a reference system, in various positions assumed or progressively reached by each item during its movement. In other words, in the case of the example shown in FIG. 1, the planar coordinates (in each plane parallel to the belt 1) of the marker of each of the items C1, C2 and C3 will be detected in each of the predefined positions P1, P2 and P3. Obviously, within the scope of the present invention, the position and the number of the points for detection of the coordinates (in particular the distance d between two successive points) may be chosen and determined depending on the requirements and/or circumstances, the minimum distance d between two successive points depending for instance on the feeding speed of the items and/or the detection speed of the video cameras 3 and 4.

In order to facilitate the recognition of the markers by the video cameras 3 and 4, the equipment may be provided with lighting means (not shown in the Figures) arranged along the belt 1, in particular in the region of the video cameras 3 and 4, for example two LED illuminators may be arranged on opposite sides of the belt 1.

The equipment 100 further comprises a robot 30 connected to the central unit 20 (for example by cable or also wirelessly, so as to be able to receive signals emitted by the unit 20), said robot 30 comprising essentially a support frame 31 arranged straddling the belt 1 (so as to be passed through by the belt 1), along with an operating portion 32 fixed to the frame 31, in particular above the belt 1.

For example, according to a non-limiting embodiment, within the scope of the present invention, it is possible to use an Adept Quattro s650H robot of the parallel type, in which the operating portion 32 comprises in particular an operating head 33 fixed to the frame 31 so that it may be displaced both on a surface and heightwise and also rotated in both opposite senses of rotation about an axis of rotation A substantially perpendicular to the belt 1, from which one or more hinged arms 35 extend (the function of the arms will be explained in detail below) so as to ensure a working space on the conveyor belt 1 of about 1300 mm (diameter), four degrees of freedom, a static-position repeatability of 0.1 mm, a position repeatability (at a belt speed of 1 m/s) of 2 mm, a cycle time, for an average travel stroke under an intermediate load, of 0.58 s (with 4 kg) and a maximum load of not less than 6 kg.

The equipment 100 also includes a printer 34 for adhesive labels, situated in the operating zone 33 of the robot 30, in particular of the rotating operating head 33 and the hinged arms 34, for example a Toshiba printer TEC B-SX4 able to ensure a printing speed of 1 Hz (1 label/s), a printing area of 50×100 mm and optionally comprising a film stripper. Obviously, although in the embodiment shown in FIG. 1, the operating part 33 of the robot 30 and the printer 34 are positioned respectively inside the frame 31 and alongside the conveyor belt 1, within the scope of the present invention their position may be chosen depending on the requirements and/or circumstances.

The printer 34 is also connected (wirelessly or by cable) to the main control unit 20 and is in particular configured to receive signals from the unit 20 and print on each label information (in particular a price) depending on the corresponding signal emitted by the unit 20.

In turn, the operating head 33 and the hinged arms 34 are configured so as to remove the labels from the printer 34 and apply each label to a predefined portion (for example to the marker) of an item or article when the latter, during its movement, is located within the radius of action of the robot 30, in particular of the arms 34. For this purpose, the end portions of the arms 34 may be provided, for example, with a Venturi effect pick-up head adapted to detach individually each of the said individual labels from a strip of adhesive labels.

The equipment 100 may also include one or more sensors (not shown in the figure) adapted to detect the height of each marker with respect to the conveyor belt 1 in predefined positions (for example the positions P1, P2 and P3) and send the data as detected to the central control unit 20.

Moreover, according to a non-limiting variant or embodiment, the equipment according to the present invention, in order to facilitate the calculation of the travel paths of the items (for example of the respective markers) may comprise an encoder (not shown in FIG. 1) designed to read the position of the conveyor belt 1, for example provided with a photoelectric sensor (applied to one of the rotating rollers supporting the conveyor belt 1), model M18 PNP NO (manufacturer Telemecanique), or a hollow-cable incremental encoder (Code RS: 499-7857, manufacturer Baumer). By means of the encoder, by detecting the speed of rotation of the roller, depending on the dimensions of said roller, it is possible to determine the feeding speed of the conveyor belt 1.

Finally, according to a further embodiment, the equipment according to the present invention may comprise a feedback viewing system (not shown in the figures) positioned downstream of the robot 30 in the direction of feeding of the items, said system having essentially the object of checking that the labels are correctly applied.

In the following a description of the labelling method according to the present invention will be provided.

The method starts with the entry or loading, into the control unit 20, of the data relating to one or more "deliveries" or despatches to be prepared, where the data relating to the various deliveries may be sent to the unit 20 from a remote source and where the deliveries may be addressed to sales and/or distribution outlets also of a different nature. Let us assume for example that two deliveries, basically two packages, identified below as delivery D and delivery E, respectively, must be prepared, where delivery D must comprise $n_1$ (for example ten) items of type C1 and $n_2$ (for example fifteen) items of type C2, while the delivery E must contains $n_3$ (for example five) items of type C1 and $n_4$ (for example five) items of type C3, where the price of the items of type C1 of the delivery D to be shown (printed) on the associated labels is different from that to be shown on the labels of the items C1 for the delivery E (for example twenty Euros in one case and thirty Euros in the other case).

The unit 20 will therefore be sent two delivery orders, one for the delivery D and one for the delivery E, by means of which the number of items, the types of items and the associated prices to be indicated on the labels will be specified.

The items or articles are then loaded onto the moving belt 1, also manually or loosely and without the need to follow a predetermined sequence, whereby the sequence of the items on the belt 1 on the contrary may be entirely random.

The items are then transported by the belt 1 and, when the items approach the identification means 1, the actual labelling method described below starts.

Let us assume for example that the first article to enter the radius of action of the bar code reader 2 is of the type C2; the reader 2, reading the bar code shown on the article tag, recognizes and identifies it as a type C2 article and sends a corresponding signal to the control unit 20 which in turn proceeds to "update" consequently the delivery D (keeping track of the articles in each case intended for the delivery D).

The unit 20 also "alerts" the printer 34 (sending a corresponding message to the printer 34) which prints on the adhesive label intended for the article just recognized the price indicated in the message (and in the order relating to delivery D).

The article, advancing further, then enters the radius of action of the video cameras 3 and 4 which record (film or photograph) the article (in particular its marker) during its movement and send the images to the central unit 20. It must be pointed out that, as to the images sent from the video cameras 3 and 4 to the unit 20, they may comprise both continuous images (films and/or videos) relating to the movement of the article (marker), for example between the positions P1 and P3, and "snap shots" of the article taken for example in the positions P1, P2 and P3. The central unit 20, processing the images received, determines the coordinates of the markers in the positions P1, P2 and P3 and extrapolates the path of the marker along a path section downstream of the video cameras 3 and 4, in particular so as to "predict" the coordinates of the marker in at least one position within the radius of action of the robot 30.

The above considerations with regard to the planar coordinates of the marker also apply to the heightwise coordinate, where in this case one or more sensors arranged upstream of the robot 30 detect the height of the marker (for example with respect to the belt 1) in the positions P1, P2 and P3. The data of the heightwise coordinates of the marker, sent from the sensors to the unit 20, are then processed by the latter; in particular, the unit 20, on the basis of the data received, extrapolates the heights of the marker along a path section downstream of the sensors, in particular so as to "predict" the height of the marker in at least one position within the radius of action of the robot 30.

The extrapolated data relating to the coordinates (at least the planar coordinates and also optionally the height coordinates) are then sent to the robot 30 which then, during the next step, removes the label from the printer 34 (from the strip of adhesive labels) and affixes it on the article, in particular on the marker when it is located within the radius of action of the robot, in particular in one of the positions which have been previously processed.

The method described above is repeated for each article loaded onto the belt 1 until completion of the deliveries entered in the central unit 20, the deliveries also being carried out simultaneously depending on the sequence of the articles on the belt 1.

Let us assume for example that the second article loaded onto the belt 1 (and therefore the second article arriving within the reading range of the reader 2) is still a type C1 article. In this case, the article labelling method will be substantially identical to that performed for labelling of the first article, the price to be shown on the adhesive label being in particular identical; the delivery D will then be updated again.

Once the type C1 articles intended for the delivery D have been "used up", the following type C1 articles will be differently priced (depending on the price indicated in the order or delivery E entered in the unit 20) and will then be assigned in each case for the delivery E.

The same is applicable to the type C2 and C3 articles which, approaching the reader 2 and the video cameras 3 and 4, will be individually identified and priced and then included in the respective deliveries D and E.

The method terminates with completion of the deliveries.

It should also be pointed out that, according to a particularly advantageous embodiment, the equipment 100, downstream of the robot 30, may comprise further selection means (not shown in FIG. 1) designed in particular to unload individually the articles from the belt 1 in unloading stations provided along the said belt 1. For example, according to the present invention, the control unit 20 may inform the unloading stations in relation to the particular article output from the robot 30 so that the article is unloaded depending on the delivery for which it has been intended.

It has therefore been shown in the above detailed description of the embodiment of the present invention illustrated in FIG. 1 that the present invention is able to achieve the predefined objects and obtain the desired results.

In particular, with the present invention it is possible to perform automated and large-scale pricing of items or articles (in particular, but not exclusively, articles of clothing), but in any case in an individual manner and depending on the identification data of said article, in particular its final destination.

As a result of the present invention it is also possible to bring together different items, which may also come from different production and/or packaging platforms, in a single delivery preparation platform, and price each single item depending on the delivery for which the item is intended.

The present invention therefore provides equipment which is able to perform the functions summarized above, the equipment according to the present invention being able to increase the margin conditions (profit margins) of each item owing to the flexibility in application of the selling price, allowing a significant reduction in the obsolescence cost (of the unsold merchandise), including the financial costs, and therefore allows an improvement in the level of service offered to the clients ("right price at the right time").

With the present invention, moreover, it is possible to perform easy reallocation of the merchandise (articles) which remains immobilized for various reasons, offering the possibility for reorganization of the product marketing policy, in particular by introducing base orders and reorders, and, finally, preventing competitors from knowing the pricing policies associated with each product.

The present invention is not limited to the embodiments described below and illustrated in the set of drawings; on the contrary the object of the present invention is defined by the claims.

The invention claimed is:

1. Equipment for processing items intended for commercial and non-commercial distribution, said equipment comprising:

a conveyor belt for transporting and/or moving said items, identification means for identifying each of said items, means for generating an individual label for each of said items, as well as means for applying individually each of the said individual labels onto an associated or corresponding item of said items, said individual labels comprising a price for each of said items, said equipment being configured so that said individual labels are generated to include said price by said means for generating said individual labels each depending on an identification data of the associated or corresponding item, acquired by the said identification means, and tracking means able to track the path of a marker applied to or already present on each of said items, a sequence of said items being entirely random, said equipment being further configured so that said individual labels are applied by said means for applying the individual labels each onto or over the marker of the associated or corresponding item on the basis of the path data of the said associated or corresponding item and wherein the said tracking means comprise recognition means able to recognize the marker of the said associated or corresponding item and track the path of the marker of the said associated or corresponding item to apply the label onto or over the marker of the said associated or corresponding item; and in that said means for applying the individual labels comprise a robot able to move individually each of the said individual labels at least between its pick-up position and its position for application onto or over the corresponding marker, said robot being displaceable both on a surface and heightwise and also rotated in both opposite senses of rotation about an axis of rotation (A) substantially perpendicular to the belt.

2. The equipment according to claim 1, wherein said identification means comprise at least one bar code reader and a tele and/or video camera.

3. The equipment according to claim 1, wherein said means for generating said individual labels comprise at least one adhesive label printer.

4. The equipment according to claim 2, wherein said tracking means are able to detect the path of each of the said markers in the visual field of said at least one video camera and wherein said equipment further comprises means able to calculate or extrapolate the position of each of the said markers downstream of the visual field of said at least one video camera and within the radius of action of said means for applying the said individual labels.

5. The equipment according to claim 1, wherein said equipment further comprises means for detecting the height of each of the said items at least within a radius of action of said means for applying said individual labels.

6. The equipment according to claim 5, wherein said means for detecting the height of each of said items are designed to detect the height of each of said markers.

7. The equipment according to claim 6, wherein said height detection means comprise at least one optical sensor.

8. The equipment according to claim 1, wherein said means for applying said individual labels comprise pick-up means for picking up individually each of said labels from the said means for generating said individual labels and individually applying each of said individual labels onto the associated or corresponding item.

9. The equipment according to claim 8, wherein said pick-up means comprise a Venturi effect pick-up head able to detach individually each of the said individual labels from a strip of adhesive labels.

10. The equipment according to claim 1, said equipment is managed electronically by means of at least one control unit.

11. The equipment according to claim 10, wherein said at least one control unit is able to receive from an external source individual data and/or instructions relating to each of the said items.

12. The equipment according to claim 11, wherein said at least one control unit is able to compare said individual data and/or instructions received from said external source with the individual data of each of the said items detected by said identification means and manage the generation of each of said individual labels on the basis of the combination of said data and/or instructions received from said external source and the data detected by said identification means.

13. The equipment according to claim 11, wherein said at least one control unit is able to receive said individual data and/or instructions relating to each of the said items by cable and/or wirelessly.

14. The equipment according to claim 1, said equipment further comprising feedback viewing means able to verify the correct application of the said individual labels.

15. A method for processing items intended for commercial and non-commercial distribution, by means of equipment according to claim 1, said method comprising the transportation and/or movement of said items along a predefined path and identification of each of said items, said method further comprising the generation of an individual label for each of said items and the individual application of each of the said individual labels onto the associated or corresponding item, said individual labels comprising a price for each of said items, whereby according to said method said individual labels are generated to include said price each depending on the identification data of the associated or corresponding item, acquired during identification of said item;

a sequence of said items being entirely random, said method comprising the recognition of a marker applied onto or already present on each of said items and the calculation or extrapolation of the spatial coordinates of the marker in at least one predefined position along the said path of the associated item, said method further comprising the application of the associated individual label onto or over the marker, the application being performed by a robot able to move individually each of the said individual labels at least between its pick-up position and its position for application onto or over a marker corresponding to said each of the said individual labels, said robot being displaceable both on a surface and heightwise and also rotated in both opposite senses of rotation about an axis of rotation (A) substantially perpendicular to the belt.

16. The method according to claim 15, wherein the calculation or extrapolation of the said spatial coordinates is performed on the basis of images showing the movement of each of said markers.

17. The method according to claim 16, wherein the calculation or extrapolation of the said spatial coordinates comprise the extrapolation of the heights of the marker along a path section.

18. The method according to claim 15, wherein the detection of said path of each of the said markers is performed in the visual field of at least one camera.

19. The method according to claim 18, further comprising a processing of both continuous images and snap shots detected by said at least one camera to predict the coordinates of the marker in at least one position within the radius of action of the robot.

20. The method according to claim 15, further comprising a generation of said identification data by a combination of individual data and/or instructions relating to each of the items received from an external source and individual data of each of the items detected by the identification means.

21. The method according to claim 15, further comprising an individual unloading of the article from the belt in relation to an article output from the robot.

22. The method according to claim 15, further comprising a feedback step in order to check that the labels are correctly applied.

* * * * *